United States Patent [19]

Magiera

[11] 4,074,906

[45] Feb. 21, 1978

[54] GAME AND APPARATUS

[75] Inventor: David L. Magiera, Bloomington, Minn.

[73] Assignee: Wicks & Nemer, P.A., Minneapolis, Minn.

[21] Appl. No.: 718,948

[22] Filed: Aug. 30, 1976

Related U.S. Application Data

[63] Continuation-in-part of Ser. No. 573,019, April 30, 1975, abandoned.

[51] Int. Cl.[2] ..... A63F 3/00; A63F 5/00

[52] U.S. Cl. ..... 273/243; 273/1 R; 273/293; 273/141 R; 273/292

[58] Field of Search ..... 273/134, 152.1, 152.41, 273/1, 141

[56] References Cited

U.S. PATENT DOCUMENTS

| | | | |
|---|---|---|---|
| D. 222,490 | 10/1971 | Alaska | 273/152.41 UX |
| 1,034,402 | 7/1912 | Hardy | 273/152.1 |
| 3,033,572 | 5/1962 | Thibault | 273/134 C |
| 3,815,919 | 6/1974 | Cain et al. | 273/134 AD |
| 3,831,946 | 8/1974 | Denalsky | 273/134 AD |
| 3,889,954 | 6/1975 | Malisow | 273/134 C |

*Primary Examiner*—Delbert B. Lowe
*Attorney, Agent, or Firm*—Wicks & Nemer

[57] ABSTRACT

Game apparatus is disclosed having a game card playing chance taking apparatus for randomly determining the play of the game cards. The preferred embodiment of the game apparatus further includes a set of game playing cards and chance taking apparatus. The playing cards, in the preferred embodiment, include three separately identifiable portions, with the first and second portions having a random numerical value associated therewith and the third portion having a numerical value associated therewith which is equal to the sum of the associated numerical values of the first and second portions. The chance taking apparatus randomly identifies one of the three card portions. The game card playing chance taking apparatus is shown in a first preferred form as a game board and game markers and is shown in a second preferred form as spinner apparatus.

21 Claims, 4 Drawing Figures

GAME AND APPARATUS

CROSS REFERENCE

This is a continuation-in-part of application Ser. No. 573,019 filed Apr. 30, 1975, by the same inventor, now abandoned.

BACKGROUND

The present invention relates generally to game apparatus and more particularly to a game apparatus including chance.

With the increasing amounts of leisure time available to persons generally in modern society, an increasing need has been felt for amusement devices to occupy such leisure time. A selected class of such amusement devices has been generally favored as providing substantially nonrepetitive play, requiring logic and intelligent decision making during play, and generally maintaining a high degree of interest for an extended period of time. Game apparatus is within this selected class.

SUMMARY

The preferred embodiment of the present invention includes game card playing chance taking apparatus. Also provided are game playing cards having a first portion and a second portion. The first portion is separate and identifiable from the second portion and both have a numerical value associated therewith. Chance taking apparatus is further provided for randomly identifying either the first or second portion of the game cards.

It is thus a primary object of the present invention to provide novel game apparatus.

It is further an object of the present invention to provide such apparatus for allowing the play of game apparatus including chance.

These and further objects and advantages of the present invention become clearer in light of the following detailed description of illustrative embodiments of this invention described in connection with the drawings.

DESCRIPTION OF THE DRAWINGS

The illustrative embodiments may best be described by reference to the accompanying drawings where.

DESCRIPTION

Figure 1:
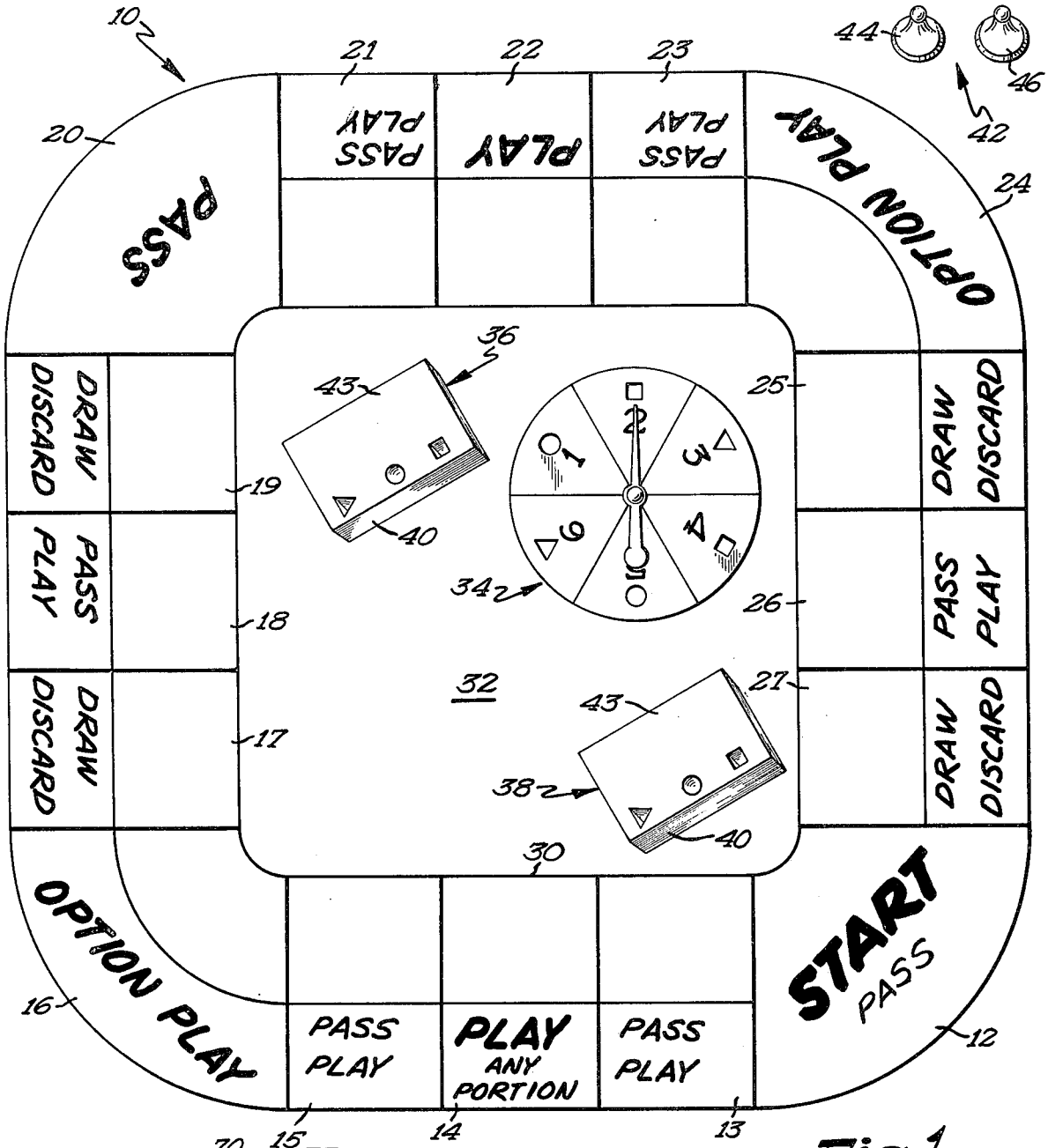
FIG. 1 shows a top plan view of a game board according to the present invention, including plan and perspective views of the various remaining apparatus for play of the game apparatus.

In FIG. 1, a game board used in the game apparatus of the present invention is shown and generally designated 10. Game board 10 includes a plurality of marked spaces, locations, or areas 12–27 constituting a path of progression about board 10, which path is generally designated 30. In particular, path 30 includes locations 12–27 arranged sequentially and continuously to form a border around the outer edge of board 10 and enclose a central portion 32. It will be obvious to those skilled in the art that the path need not be so arranged but may be any path in any arrangement about the board. A path arranged about the border of the board is deemed preferred, however.

Figure 3:
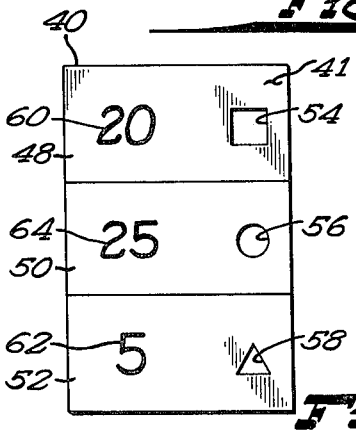
FIG. 3 represents an exemplary card for use during the play of the game apparatus of FIG. 1.

Within central portion 32 of board 10, chance taking apparatus 34 is shown in its preferred form as spinner apparatus. Also within central portion 32 of board 10 are stacks of cards, shown in the preferred embodiment as a draw deck or stack 36 and a discard deck or stack 38. Cards comprising stacks 36 and 38 are generally designated 40, an example of which is generally shown in FIG. 3. Cards 40 have a front 41 and a back 43

Also shown in FIG. 1 are a plurality of individual playing elements, markers, or pieces, generally designated 42, shown as situated adjacent to board 10. Pieces 42 include separate player pieces 44 and 46, which may be items specifically related to rules of the game, or other pieces which can be separately identified.

Path 30 includes a "START-PASS" location 12, "PASS PLAY" locations 13, 15, 18, 21, 23, and 26, "PLAY ANY PORTION" location 14, "OPTION PLAY" locations 16 and 24, "DRAW DISCARD" locations 17, 19, 25, and 27, "PASS" location 20, and "PLAY" location 22, whose functions shall be explained further hereinafter.

It should then be noted that game board 10 and pieces 42 then constitute, in a first preferred form, game card playing chance taking apparatus as shall be explained further hereinafter.

As best seen in FIG. 3, cards 40 include generally three areas of portions, generally designated 48, 50, and 52, respectively. Portions 48, 50, and 52 are separately identifiable from each other by suitable identification members. In the preferred embodiment, the identification members consist of a square member 54, a circle member 56, and a triangle member 58 punched in and through card 40. Therefore, the first portion of card 40 is square designated portion 48, the second portion of card 40 is circle designated portion 50, and the third portion of card 40 is triangle designated portion 52.

Portion 48 includes an integer 60 located on front 41 therein giving portion 48 a numerical value. Portion 52 includes an integer 62 located on front 41 therein giving portion 52 a numerical value. Portion 50 includes an integer 64 located on front 41 therein giving portion 50 a numerical value, or total point value, equal to the sum of the numerical values of integers 60 and 62.

In the preferred embodiment, there are a total of 52 cards 40. Integers 60 and 62 are integer members of the set consisting of the integers 5, 10, 15, and 20. Integer 64 is an integer member from the set consisting of the integers 10, 15, 20, 25, 30, 35, and 40. The integers 60, 62, and 64 located within portions 48, 52, and 50, respectively, of cards 40 for a preferred deck of cards are set out in the following table.

| CARD | INTEGER 60 | INTEGER 62 | INTEGER 64 |
|---|---|---|---|
| 1 | 5 | 20 | 25 |
| 2 | 20 | 5 | 25 |
| 3 | 10 | 5 | 15 |
| 4 | 15 | 10 | 25 |
| 5 | 15 | 10 | 25 |
| 6 | 10 | 10 | 20 |
| 7 | 10 | 5 | 15 |
| 8 | 20 | 15 | 35 |
| 9 | 5 | 15 | 20 |
| 10 | 15 | 10 | 25 |
| 11 | 5 | 20 | 25 |
| 12 | 5 | 20 | 25 |
| 13 | 10 | 10 | 20 |
| 14 | 20 | 20 | 40 |

-continued

| CARD | INTEGER 60 | INTEGER 62 | INTEGER 64 |
|---|---|---|---|
| 15 | 5 | 15 | 20 |
| 16 | 5 | 10 | 15 |
| 17 | 5 | 20 | 25 |
| 18 | 5 | 5 | 10 |
| 19 | 10 | 10 | 20 |
| 20 | 15 | 15 | 30 |
| 21 | 15 | 15 | 30 |
| 22 | 15 | 15 | 30 |
| 23 | 15 | 15 | 30 |
| 24 | 20 | 20 | 40 |
| 25 | 10 | 10 | 20 |
| 26 | 15 | 20 | 35 |
| 27 | 10 | 20 | 35 |
| 28 | 20 | 5 | 25 |
| 29 | 15 | 10 | 25 |
| 30 | 15 | 10 | 25 |
| 31 | 5 | 5 | 10 |
| 32 | 10 | 15 | 25 |
| 33 | 10 | 15 | 25 |
| 34 | 20 | 5 | 25 |
| 35 | 20 | 15 | 35 |
| 36 | 5 | 20 | 25 |
| 37 | 20 | 15 | 35 |
| 38 | 20 | 15 | 35 |
| 39 | 20 | 15 | 35 |
| 40 | 20 | 10 | 30 |
| 41 | 10 | 20 | 30 |
| 42 | 10 | 20 | 30 |
| 43 | 10 | 20 | 30 |
| 44 | 20 | 5 | 25 |
| 45 | 15 | 5 | 20 |
| 46 | 10 | 10 | 30 |
| 47 | 15 | 5 | 20 |
| 48 | 20 | 10 | 30 |
| 49 | 5 | 5 | 10 |
| 50 | 10 | 5 | 15 |
| 51 | 5 | 10 | 15 |
| 52 | 5 | 5 | 10 |

Figure 2:
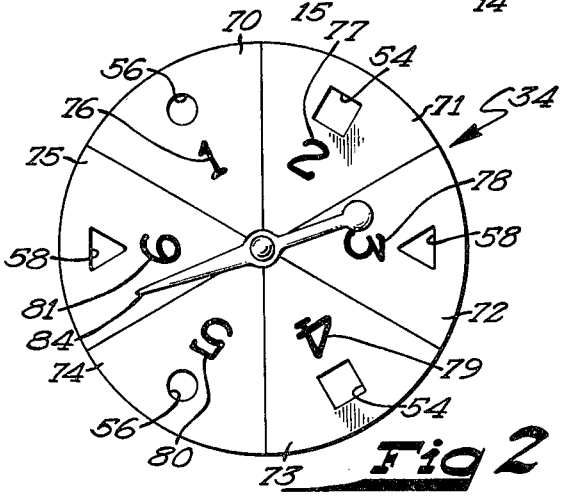
FIG. 2 shows a top view of the preferred embodiment of the chance taking apparatus for use during the play of the game apparatus of FIG. 1.

Chance taking apparatus 34 for randomly determining the movement of game markers 42 along path 30 and for randomly identifying either portion 48, 50, or 52 of cards 40 is shown in its preferred form in FIG. 2 as spinner apparatus. Spinner 34 generally includes six wedge-shaped areas 70–75 each including first separately identifiable members 76–81, shown as integers 1, 2, 3, 4, 5, and 6. Spinner 34 further includes members 54, 56, and 58 punched therein, with each area 70–75 having one of the members 54, 56, and 58 as shown. Spinner 34 further includes spinning member 84.

By spinning member 84, the member 76–81 indicated by member 84, when it comes to a stationary position on spinner 34, is the randomly chosen member for determining the movement of the game markers 42 along path 30. Additionally, the member 54, 56, or 58 indicated by member 84, when it comes to a stationary position on spinner 34, is the randomly chosen member for identifying either portion 48, 50, or 52 of cards 40.

The objective of the game apparatus of the present invention is to have accumulated the most total points once the entire draw deck 36 has been played or until there are not enough cards remaining in the draw deck 36 to deal another hand to each player.

Each player is assigned a playing piece such as playing pieces 44 and 46 as shown in FIG. 1. Each playing piece is then placed on start position 12. The game is begun with each player spinning spinner 34 to determine the starting player. In the preferred embodiment, the player obtaining the highest numerical value of members 76–81 begins play followed by the remaining players in clockwise order. Cards 40 are then shuffled and each player is dealt five cards. The remaining cards 40 are placed in the draw deck 36.

The first player, assumed for the purpose of this description to have been assigned playing piece 44, is then ready to begin play. The player spins spinning member 84 and moves the appropriate number of spaces along path 30 according to members 76–81 identified by member 84. For example, the first player would move piece 44 to location 18 if member 84 indicates member 81 as shown in FIG. 2.

If the game piece 44 lands on one of the "PASS PLAY" locations 13, 15, 18, 21, 23, and 26, the player has an option to "PASS" or "PLAY". If the player decides to "PASS", the player skips the remaining part of his turn, or in other words, passes the remaining part of his turn, and the spinner 34 advances to the next player who continues play. If the player decides to "PLAY", each player lays down a card 40 of the player's choice. The player having the card 40 with the largest numerical value indicated by integer 60, 64, or 62 located in the portion 48, 50, or 52 indicated by spinning member 84 of spinner 34 collects all cards 40 laid down by players and sets them aside for determination of the winning player as will be explained further hereinafter. For example, the player having the card with the largest numerical value indicated by integer 60 of portion 48 as indicated by spinner 34 as shown in FIG. 1 is the winner, in that member 84 indicates member 54 which identifies portion 48 of cards 40.

If two or more players lay down cards 40 having the highest identical numerical values in the portion indicated by spinner 34, or in other words, a tie results, the players involved in the tie draw a card 40 from draw deck 36 and spinning member 34 is again spun by the previous player who had spun the spinner 34. The players do not move their corresponding game markers 42. The involved players then lay down another card 40 and the player laying the card 40 having the largest numerical value indicated by integer 60, 64, or 62 of portion 48, 50, or 52 indicated by spinning member 84 collects all the cards 40 laid down by the players including those cards involved in breaking the tie together with the cards originally laid down and sets them aside for determination of the winning player as will be explained further hereinafter. If a tie should reoccur, this process is repeated.

For example, if the first player lays down card 40 designated number 2 of the table and the second player lays down card 40 designated number 10 of the table, the first player would collect both cards if, as shown in FIG. 1, member 84 indicates member 54 which identifies portion 48 of card 40, in that the numerical value indicated by integer 60 of card 40 designated number 2 is 20 while for card 40 designated number 10 the numerical value is 15. If member 84 indicates member 58, as shown in FIG. 2, which identifies portion 52 of card 40, the second player would collect both cards in that the numerical value indicated by integer 62 of card 40 designated number 2 is 5 while for card 40 designated number 10 the numerical value is 10. However, if member 84 indicates member 56 which identifies portion 50 of card 40, a tie occurs in that the numerical values indicated by integer 64 of both cards 40 designated number 2 and number 10 is 25 and therefore the procedure explained hereinbefore for breaking ties must be followed.

If the player lands on the "PLAY ANY PORTION" location 14, the player must "PLAY" as previously explained hereinbefore, but may choose any portion 48, 50, or 52, whichever he desires, rather than the portion 48, 50, or 52 indicated by spinner 34.

If the player lands on the "OPTION PLAY" location 16 or 24, the player has an option to "PASS" or "PLAY," as previously explained hereinbefore, or may draw the top card 40 from draw deck 36 and discard a card 40 of his choice to the discard deck 38.

If the player lands on the "DRAW DISCARD" location 17, 19, 25, or 27, the player draws the top card 40 from draw deck 36 and discards a card 40 of his choice to the discard deck 38.

If the player lands on the "PASS" location 20, the player must "PASS" as previously explained hereinbefore.

If the player lands on the "PLAY" location 22, the player must "PLAY" as previously explained.

It should be noted that "START-PASS" location 12 acts as a starting position at the beginning of play and thereafter acts as a "PASS" location. After the player has moved his game marker 44 and followed the instructions located on the location 12–27 upon which marker 44 rests, spinner 34 advances to the next player who continues play.

After the players have played all the cards initially dealt to them at the beginning of play, each player is then dealt an additional five cards 40 from the draw deck 36 and play resumes as previously explained hereinbefore.

If there are not enough cards remaining in deck 36 to deal five cards to each player, the play of the game has been completed. To determine the winning player, each player adds the numerical values of integers 64 of each card 40 in his possession collected during play of the game. The player with the highest total of numerical values of integers 64 is the winning player.

Figure 4:
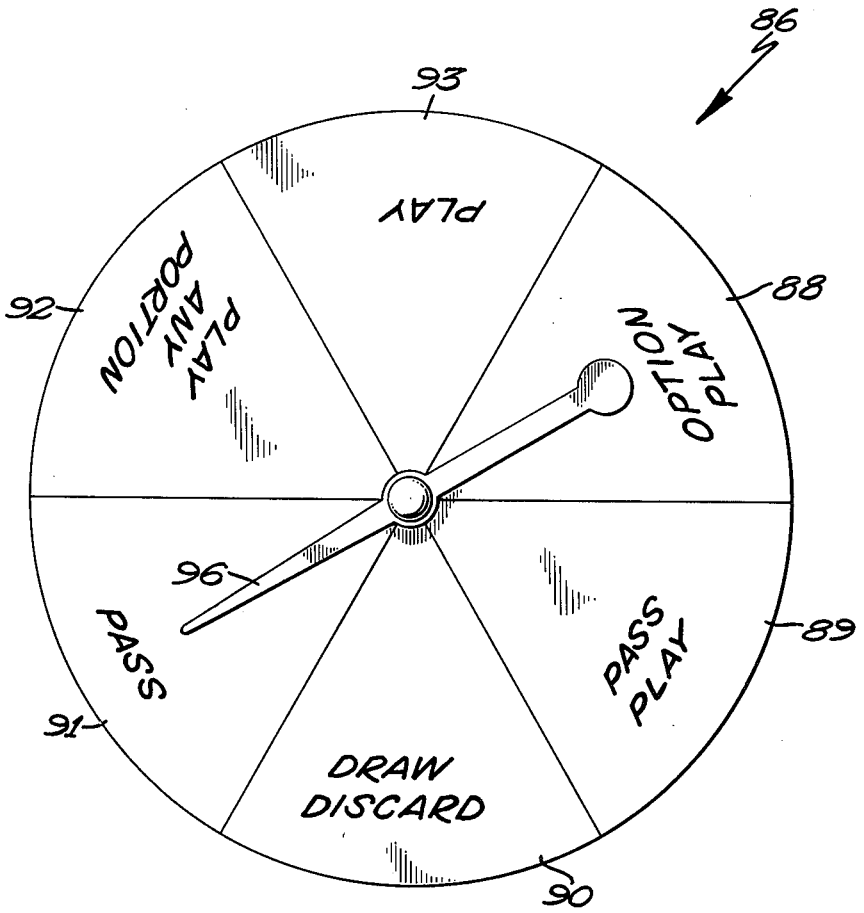
FIG. 4 shows a top view of an alternate embodiment of the game card playing chance taking apparatus for play of the game apparatus.

In FIG. 4, a game card playing chance taking apparatus for randomly determining the play of game cards 40 is shown in its second preferred form as spinner apparatus and generally designated 86. Spinner 86 generally includes six wedge-shaped areas 88–93 and a spinning member 96. Area 88 includes game card playing instructions corresponding to locations 16 and 24 of game board 10. Area 89 includes game card playing instructions corresponding to locations 13, 15, 18, 21, 23, and 26 of game board 10. Area 90 includes game card playing instructions corresponding to locations 17, 19, 25, and 27 of game board 10. Area 91 includes game card playing instructions corresponding to location 20 of game board 10. Area 92 includes game card playing instructions corresponding to location 14 of game board 10. Area 93 includes game card playing instructions corresponding to location 22 of game board 10.

It can then be noted that the function of spinner 86 is identical to the function of game board 10 and game pieces 42 and can be substituted therefor. For example, according to the teachings of the present invention, a spinning member similar to spinning member 96 could be mounted in the center of game board 10 to indicate one of the locations 12–27 in a manner analogous to spinning member 96 indicating one of the areas 88–93 of spinner 86.

In operation, the game is begun with each player spinning spinner 34 to determine the starting player. In the preferred embodiment, the player obtaining the highest numerical value of members 76–81 begins play followed by the remaining players in clockwise order. Cards 40 are then shuffled and each player is then dealt five cards. The remaining cards 40 are then placed in the draw deck 36.

The first player is then ready to begin play. The player spins spinning member 96 of spinner 86 and follows the hereinbefore explained game instructions of the area, of areas 88–93, indicated by member 96 when it comes to a stationary position on spinner 86. For example, if member 96 was located in the position as shown in FIG. 4, the player must "PASS" as explained hereinbefore. It should be noted that when it is necessary for portion 48, 50, or 52 of a card to be randomly chosen for play of the game cards 40, as previously explained hereinbefore, spinning member 84 of spinner 34 is spun in the manner previously explained.

Now that the basic teachings of the present invention have been explained, many extensions and variations will be obvious to one havin ordinary skill in the art. For example, although the apparatus of the second preferred embodiment includes spinner 34 which indicates both members 76–81 and members 54, 56, and 58, chance taking apparatus according to the teachings of the present invention can be provided which only indicate members 54, 56, and 58.

Also, it should be noted that although spinner 86 is shown as including only six wedge-shaped areas 88–93, fewer or more such areas and areas of differing occurrences and/or extents can be included, with each including game card playing instruction according to the teachings of the present invention.

Further, although game card playing chance taking apparatus is shown in preferred forms as a game board and markers and as spinner apparatus, other forms and types of chance taking apparatus can be used according to the teachings of the present invention.

Additionally, although the apparatus of the present invention is shown as including a first chance taking apparatus 34 for indicating members 54, 56, and 58 and a second chance taking apparatus, shown as board 10 and markers 42 and spinner 86, for randomly determining the play of the game cards according to the teachings of the present invention, a single chance taking apparatus can be used and will be within the skill of persons skilled in the art after the teachings of the present invention have been read and understood.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Game apparatus for playing by at least two persons comprising, in combination: a plurality of game cards, with the game cards having a first portion and a second portion, with the first portion being separate from the second portion, with the first portion having a first numerical value associated therewith, and with the second portion having a second numerical value associated therewith; means for separately identifying the first portion from the second portion of the game cards; game card playing chance taking apparatus for randomly determining the play of the game cards; and chance taking apparatus for randomly identifying either the first or second portion of the game cards by indicating the corresponding identifying means.

2. The apparatus of claim 1 wherein the game card playing chance taking apparatus comprises; in combination: a game board having a plurality of game areas thereon arranged along a path of progression, with at least some of the game areas being game card playing areas; and at least two game markers representing the persons playing the game apparatus for movement along the path; and wherein the chance taking apparatus further includes apparatus for randomly determining the movement of the game markers along the path.

3. The apparatus of claim 2 wherein the game cards further include a third portion, with the third portion having a third numerical value associated therewith, with the third numerical value being equal to the sum of the first and second numerical values, wherein the identifying means further provides means for separately identifying the third portion from the first portion and from the second portion of the game cards, and wherein the chance taking apparatus randomly identifies either the first, second, or third portion of the game cards by indicating the corresponding identifying means.

4. The apparatus of claim 2 wherein the game cards further include a third portion, with the third portion having a third numerical value associated therewith, wherein the identifying means further provides means for separately identifying the third portion from the first portion and the second portion of the game cards, and wherein the chance taking apparatus randomly identifies either the first, second, or third portion of the game cards by indicating the identifying means.

5. The apparatus of claim 2 wherein the game areas are arranged sequentially and continuously to form a border around the outer edge of the game board and enclose a central portion.

6. The apparatus of claim 2 wherein the chance taking apparatus comprises spinner apparatus including wedge shaped areas and a spinning member, with each of the wedge shaped areas including a first separately identifiable member for determining the movement of the game markers and also including the means for separately identifying the first portion from the second portion of the game cards.

7. The apparatus of claim 6 wherein the means for separately identifying the first portion from the second portion of the game cards comprises a square opening, and a triangular opening punched in and through the game cards and the wedge shaped areas of the spinner apparatus.

8. The apparatus of claim 3 wherein the chance taking apparatus comprises spinner apparatus including wedge shaped areas and a spinning member, with the wedge-shaped areas including a first separately identifiable member for determining the movement of the game markers and also including the means for separately identifying the first portion from the second portion of the game cards.

9. The apparatus of claim 8 wherein the means for separately identifying the first, the second, and the third portions of the game cards from each other comprise a square opening, a circular opening, and a triangular opening punched in and through the game cards and wedge-shaped areas of the spinner apparatus.

10. The apparatus of claim 2 wherein the chance taking apparatus includes a plurality of first separately identifiable members for determining the movement of the game markers; means for separately identifying the first portion from the second portion of the game cards; and means for randomly choosing one of the first separately identifiable members and for indicating the means for separately identifying the first portion from the second portion of the game cards.

11. The apparatus of claim 2 wherein the means for separately identifying the first portion from the second portion of the game cards comprises a square opening and a triangular opening punched in and through the game cards.

12. The apparatus of claim 1 wherein the game cards further include a third portion, with the third portion having a third numerical vaue associated therewith, wherein the identifying means further provides means for separately identifying the third portion from the first portion and the second portion of the game cards, and wherein the chance taking apparatus randomly identifies either the first, second, or third portion of the game cards by indicating the identifying means.

13. The apparatus of claim 12 wherein the chance taking apparatus comprises a spinner apparatus including wedge-shaped areas and a spinning member, with the wedge-shaped areas including the means for separately identifying the first portion from the second portion of the game cards and for separately identifying the third portion from the first portion and the second portion of the game cards.

14. The apparatus of claim 12 wherein the game card playing chance taking apparatus comprises spinner apparatus including wedge-shaped areas and a spinning member, with each of the wedge-shaped areas including means for randomly determining the play of the game cards.

15. The apparatus of claim 1 wherein the chance taking apparatus comprises spinner apparatus including wedge-shaped areas and a spinning member, with the wedge-shaped areas including the means for separately identifying the first portion from the second portion of the game cards.

16. The apparatus of claim 15 wherein the means for separately identifying the first portion from the second portion of the game cards comprises a square opening, and a triangular opening punched in and through the game cards and the wedge-shaped areas of the spinner apparatus.

17. The apparatus of claim 16 wherein the game card playing chance taking apparatus comprises second spinner apparatus including wedge-shaped areas and a spinning member, with each of the wedge-shaped areas including means for randomly determining the play of the game cards.

18. The apparatus of claim 1 wherein the chance taking apparatus includes means for separately identifying the first portion from the second portion of the game cards; and means for indicating the means for separately identifying the first portion from the second portion of the game cards.

19. The apparatus of claim 1 wherein the means for separately identifying the first portion from the second portion of the game cards comprises a square opening and a triangular opening punched in and through the game cards.

20. The apparatus of claim 1 wherein the game card playing chance taking apparatus comprises spinner apparatus including wedge-shaped areas and a spinning member, with each of the wedge-shaped areas including means for randomly determining the play of the game cards.

21. The apparatus of claim 1 wherein the game card playing chance taking apparatus includes means for randomly determining the play of the game cards; and means for indicating the means for randomly determining the play of the game cards.

* * * * *